US010377525B2

(12) United States Patent
Saba

(10) Patent No.: US 10,377,525 B2
(45) Date of Patent: Aug. 13, 2019

(54) PACKAGE WITH AUXILIARY CONTAINER LID

(71) Applicant: Saba Saba, Temecula, CA (US)

(72) Inventor: Saba Saba, Temecula, CA (US)

( * ) Notice: Subject to any disclaimer, the term of this patent is extended or adjusted under 35 U.S.C. 154(b) by 0 days.

(21) Appl. No.: 15/836,769

(22) Filed: Dec. 8, 2017

(65) Prior Publication Data

US 2019/0177032 A1 Jun. 13, 2019

(51) Int. Cl.

*B65D 51/18* (2006.01)
*B65D 5/64* (2006.01)
*B65D 43/02* (2006.01)

(52) U.S. Cl.

CPC ..... *B65D 5/643* (2013.01); *B65D 43/0235* (2013.01); *B65D 51/18* (2013.01); *B65D 2251/0018* (2013.01); *B65D 2543/00194* (2013.01); *B65D 2543/00425* (2013.01); *B65D 2543/00537* (2013.01)

(58) Field of Classification Search

CPC .... B65D 5/643; B65D 43/0235; B65D 51/18; B65D 5/68; B65D 2543/00537; B65D 43/0222; B65D 43/20; B65D 5/723

USPC ..... 229/125.01, 125.02, 125.05, 125.12, 229/125.13, 125.14, 125.19, 125.33, 102; 222/545; 206/265, 266, 267, 270; 220/784, 8

See application file for complete search history.

(56) References Cited

U.S. PATENT DOCUMENTS

| | | | | | |
|---|---|---|---|---|---|
| 2,030,134 | A | | 2/1936 | Burgener | |
| 2,251,283 | A | | 8/1941 | Johnson | |
| 2,306,973 | A | | 12/1942 | Mysels | |
| 2,329,297 | A | | 9/1943 | Richards | |
| 2,564,252 | A | | 8/1951 | Dickson | |
| 2,658,664 | A | | 11/1953 | Hennessey | |
| 2,805,812 | A | | 9/1957 | Seaton | |
| 2,846,130 | A | | 8/1958 | Foote | |
| 3,110,436 | A | | 11/1963 | Wagner | |
| 3,692,230 | A | | 9/1972 | Kapiloff | |
| 3,695,504 | A | * | 10/1972 | Simpson | B65D 5/727 222/531 |
| 4,488,676 | A | | 12/1984 | Halliday | |
| 4,693,414 | A | * | 9/1987 | Allen | A47J 47/01 229/125.02 |
| 5,007,541 | A | | 4/1991 | Gunn | |
| 5,115,966 | A | * | 5/1992 | McKibben | B65D 5/76 206/229 |
| 5,211,305 | A | * | 5/1993 | Horton | B65D 5/606 229/117.27 |

(Continued)

*Primary Examiner* — Christopher R Demeree

(74) *Attorney, Agent, or Firm* — Jafari Law Group, Inc.

(57) ABSTRACT

The present subject matter is directed towards a packaging container comprising at least one sheet of a packaging material defining a closed cross-section and open at an operative top end and an operative bottom end thereof. At least two flaps are provided at the operative top end and the operative bottom end of the at least one sheet, wherein the at least two flaps are sealable to each other to define an interior space for containing edible items therein. An auxiliary lid is provided on one of the operative top end and the operative bottom end, wherein the auxiliary lid is configured to snugly fit on one of the operative top end and the operative bottom end subsequent to the unsealing of the at least two flaps, thereby preventing ingress of air and other foreign matter into the interior space.

20 Claims, 5 Drawing Sheets

(56) References Cited

U.S. PATENT DOCUMENTS

| | | | | |
|---|---|---|---|---|
| 5,251,808 | A | 10/1993 | Rudd | |
| D463,742 | S * | 10/2002 | Saucier | D9/435 |
| 8,132,690 | B2 | 3/2012 | Hall | |
| 9,296,517 | B2 | 3/2016 | Hall | |
| 2003/0102240 | A1 | 6/2003 | Sidi | |
| 2006/0255107 | A1 | 11/2006 | Wright | |
| 2008/0073369 | A1 | 3/2008 | Druin | |
| 2008/0245849 | A1 * | 10/2008 | Mathieu | B65D 5/16 229/117.17 |
| 2018/0099775 | A1 * | 4/2018 | van Waarden | B65D 5/6611 |

* cited by examiner

PACKAGE WITH AUXILIARY CONTAINER LID

TECHNICAL FIELD OF THE INVENTION

The subject matter of the present invention relates to the field of packaging containers for edible items. More specifically, the present invention relates to packaging containers having an auxiliary lid for sealing the packaging container in a substantially air-tight manner.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Food items such as cereal, dry fruits, and the like are typically packed in containers or cartons made of card board or metallic laminates or polymeric laminates or any combinations thereof. In some cases, the food item is stored in the container or the carton. In some other cases, the food item is stored in a secondary polythene bag within the container. In each case, it is difficult to achieve the desired resealing of the container or the carton once the same has been opened. This allows an ingress of air and other foreign matters into the container or the carton, which may compromise the quality of the food item stored therein.

Some food items, such as cereals, should not be exposed to air as this exposure causes the cereal to lose its crunchiness. Other food items, the taste of which depends upon the aroma of that food item, should also not be left open to the environment as this causes the loss of the aroma, which again impacts the quality of the food item.

To remedy the aforementioned drawbacks, packaging containers have been developed in the art in which the polythene bags within the containers or cartons are replaced by resealable bags. The resealing is facilitated by elongate press fit formations or zip lock formations provided on the opposing panels of the bag within the carton. However, such packaging containers or cartons tend to get very cost-intensive for the manufacturer because of the sealing mechanism provided on the bag. Furthermore, using this form of packaging is also not convenient for a user since the user has to put in the effort to carefully seal the bag after use. Also, sometimes the user might be in a hurry and does not seal the bag properly. The smallest gaps between the improperly sealed sealing formations will allow the air to pass thru, which would render the use of resealable bags within the carton pointless.

There is, therefore, a need for a packaging container that overcomes the aforementioned drawbacks while having a configuration which is easy to manufacture as well as convenient to use.

It is to these ends that the present invention has been developed.

SUMMARY OF THE INVENTION

To minimize the limitations in the prior art, and to minimize other limitations that will be apparent upon reading and understanding the present specification, the present invention describes a packaging container, which includes an auxiliary lid for sealing the packaging container in a substantially air-tight manner once the packaging container has been opened or unsealed for maintaining the quality of the food item.

Different types of packaging containers are known in the art for the packaging of different kinds of food items. For example, jams are typically packaged in vacuum sealed glass jars for preserving the taste and quality of the jam until the container is opened. Similarly, coffee is also typically packed in glass or plastic jars, wherein a secondary lid is typically provided on the opening of the jar apart from the cap to preserve the aroma of the coffee until the coffee jar is unsealed. The purpose of the secondary lid, again, is to preserve the aroma of the coffee.

Food items such as cereals and dry fruits are typically packed in cartons. A typical problem associated with this type of packaging is that it is difficult to reseal the carton after unsealing. More specifically, a perfect and a substantially air-tight resealing is barely achieved in the conventional cartons. This compromises the quality of the cereal and the dry fruits. The crunchiness of the cereal and the dry fruits is lost due to air-ingress into the carton. This is not desired.

To remedy the aforementioned drawback, cartons with resealable bags have been developed in the art. However, these cartons are very expensive because of the provision of the resealing mechanism. The resealing mechanisms typically include press-fit formations or zip-lock formations configured along the width of the panels of a bag placed inside the carton. If in a hurry, the user does not seal the bag properly, air ingress in the bag occurs, which renders the use of the resealable bag moot.

It is to these ends that the packaging container in accordance with the present invention has been developed. The packaging container, as disclosed in the present invention, is an easy to manufacture and convenient to use product which overcomes the aforementioned drawbacks of the conventional packaging containers.

A packaging container, in accordance with an embodiment of the present invention comprises: at least one sheet of a packaging material defining a closed cross-section and open at an operative top end and an operative bottom end thereof; at least two flaps provided at the operative top end and the operative bottom end of the at least one sheet, the at least two flaps being sealable to each other to define an interior space for containing edible items therein; and an auxiliary lid provided on one of the operative top end and the operative bottom end, the auxiliary lid configured to snugly fit on one of the operative top end and the operative bottom end subsequent to the unsealing of the at least two flaps, thereby preventing ingress of air and other foreign matter into the interior space.

An auxiliary lid for covering a packaging box subsequent to the opening of the packaging box, in accordance with an embodiment of the present invention, comprises: a base wall; at least one sidewall extending from the base wall and defining a profile complementary to that of the packaging box for fitting on an operative top end or an operative bottom end of the packaging box; and a foam insert affixed to an inner periphery of the auxiliary lid for facilitating a snug fitment of the auxiliary lid on the packaging box, thereby preventing ingress of air and other foreign matter in the packaging box.

Another packaging container in accordance with another exemplary embodiment of the present invention, comprises: a container portion including: at least one sheet of a packaging material defining a closed cross-section and open at an operative top end and an operative bottom end thereof; and at least two flaps provided at the operative top end and the operative bottom end of the at least one sheet, the at least two flaps being sealable to each other to define an interior space for containing edible items therein, wherein the at least two flaps are sealed to each other with a rigid adhesive; and an auxiliary lid provided on one of the operative top end or the operative bottom end of the container portion, the auxiliary lid configured to snugly fit on one of the operative top end or the operative bottom end subsequent to the unsealing of the at least two flaps, thereby preventing ingress of air and other foreign matter into the interior space, wherein the auxiliary lid is attached to the container portion with a soft removable adhesive situated along a portion of an internal bottom edge of the auxiliary lid.

Another auxiliary lid for covering a packaging box subsequent to the opening of the packaging box, in accordance with an exemplary embodiment of the present invention, comprises: a base wall; and at least one sidewall extending from the base wall and defining a profile complementary to that of the packaging box for fitting on an operative top end or an operative bottom end of the packaging box, wherein: the auxiliary lid is attached to a container portion of the packaging box with a soft removable adhesive situated along a portion of an internal bottom edge of the auxiliary lid; and the package box comprises of a container portion including at least one sheet of a packaging material defining a closed cross-section and open at the operative top end and the operative bottom end of the packaging box, and at least two flaps provided at the operative top end and the operative bottom end of the at least one sheet, the at least two flaps being sealable to each other to define an interior space for containing edible items therein, the at least two flaps sealed to each other with a rigid adhesive.

It is an objective of the present invention to provide a packaging container for packaging food items such as cereals and dry-fruits, in which the crunchiness and the flavor thereof is not compromised subsequent to the unsealing of the packaging container.

It is another objective of the present invention to provide a packaging container in which an auxiliary lid of the packaging container snugly fits onto the container the in order to seal the container in a substantially air-tight manner.

It is yet another objective of the present invention to provide a packaging container which is easy and not cost-intensive to manufacture.

It is still another objective of the present invention to provide a packaging container which is convenient and easy to use.

These and many other advantages and features of the present invention are described herein with specificity so as to make the present invention understandable to one of ordinary skill in the art, both with respect to how to practice the present invention and how to make the present invention.

BRIEF DESCRIPTION OF THE DRAWINGS

Elements in the figures have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. The drawings that accompany the detailed description may be briefly described as follows.

DETAILED DESCRIPTION OF THE INVENTION

Figure 1A:
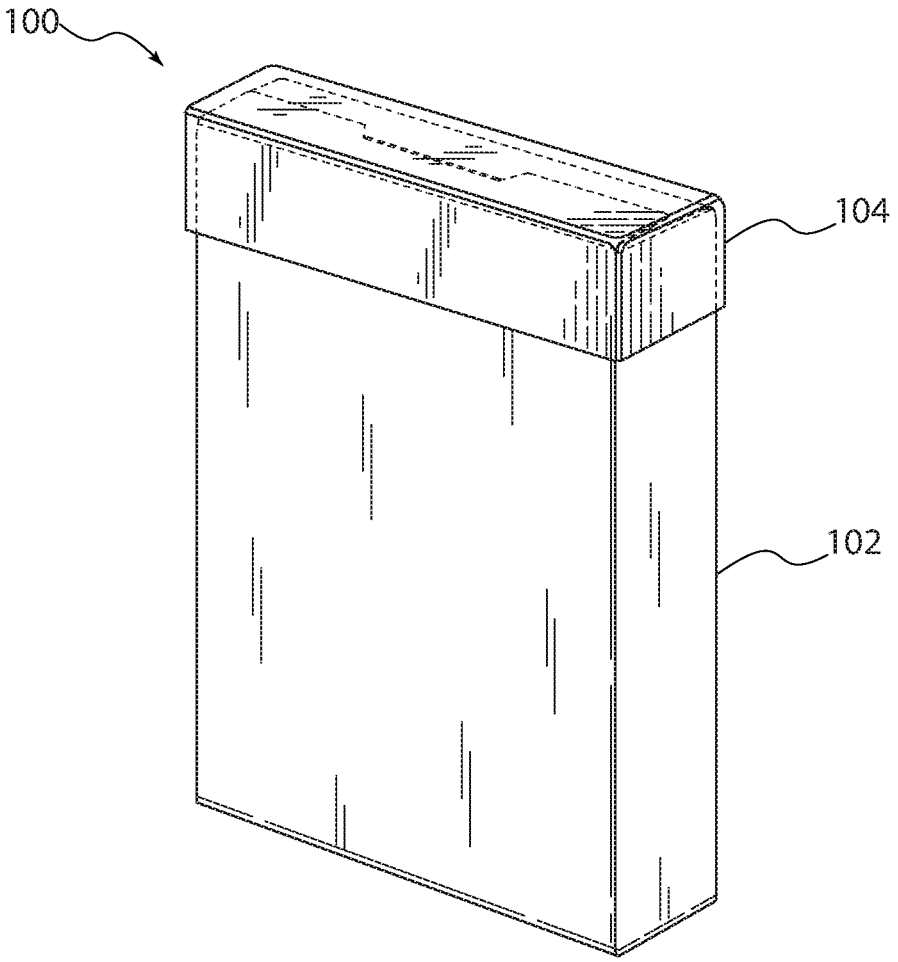
FIG. 1A illustrates an isometric view of a packaging container, in accordance with an exemplary embodiment of the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C may be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Figure 1B:
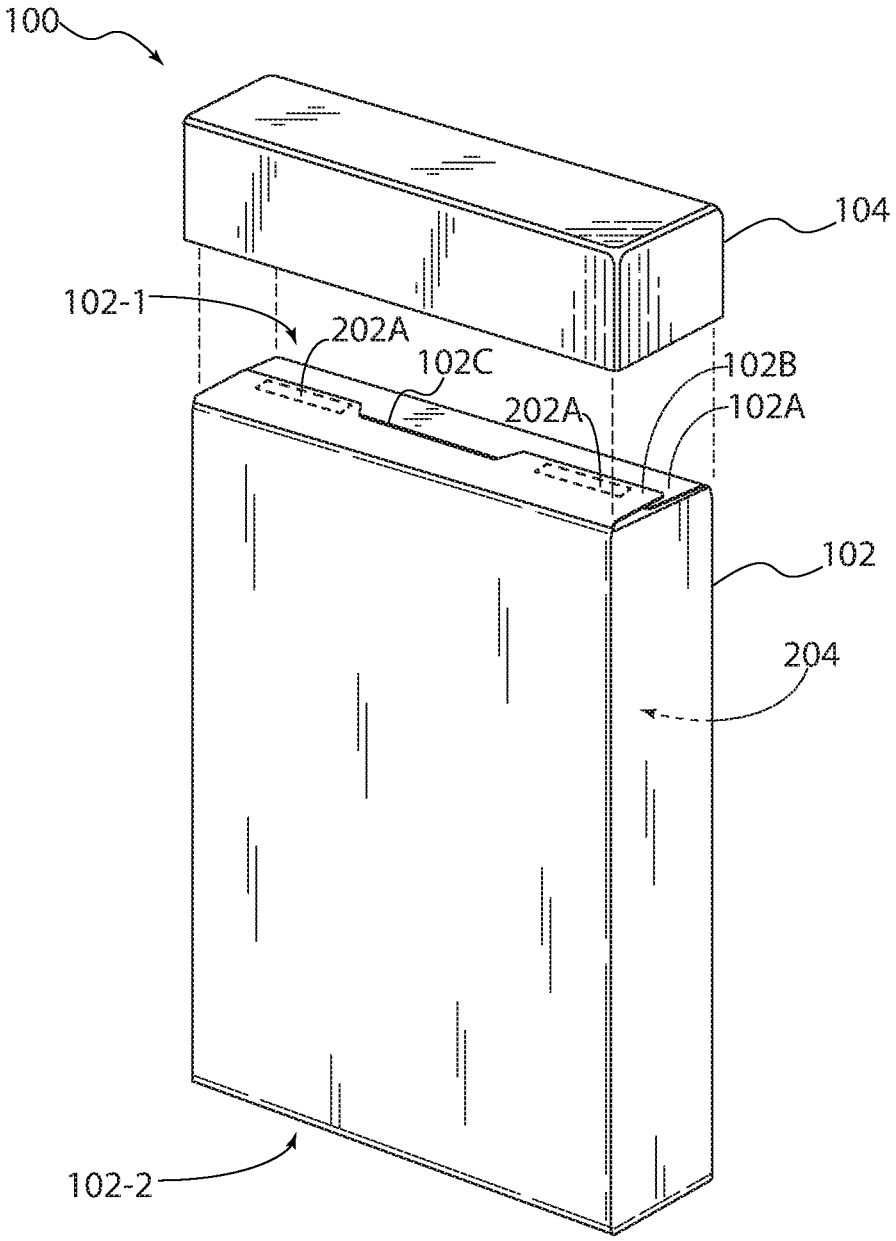
FIG. 1B illustrates an exploded isometric view of the packaging container of FIG. 1A.

Turning now to the figures, FIG. 1A and FIG. 1B illustrate isometric views of a packaging container 100 (hereinafter interchangeably referred to as container 100), in accordance with an embodiment of the present invention. The container 100 comprises a container portion 102 and an auxiliary lid 104. The container portion 102 of the container 100 is made of at least one sheet of a packaging material that defines a closed cross-section and is open (and sealable) at an operative top end 102-1 and an operative bottom end 102-2 thereof. More specifically, in exemplary embodiments the container portion 102 may be made of one sheet of the packaging material by performing appropriate folding operations on that single sheet. In another exemplary embodiment, the container portion 102 is made by adjoining more than one sheet of the packaging material to define the closed cross-section. Without limiting the scope of the present invention, the packaging material may be cardboard, metallic laminates, polymeric laminates, or any combination thereof. However, it is to be noted that the packaging material is not restricted to the aforementioned materials.

The container portion 102 has at least two flaps 102A, 102B provided at the operative top end 102-1 and the operative bottom end 102-2 of the closed cross-section defined by the at least one sheet. The two flaps 102A, 102B are sealable to each other to define an interior space 204 of the container portion 102 for containing the food items therein. In one embodiment, the flaps 102A, 102B are sealed by means of a first adhesive, which may be applied between flaps 102A and 102B. In exemplary embodiments, the first adhesive is a rigid 201A. The rigid adhesive 201A may be, for example and without limiting the scope of the present invention, a hot melt adhesive that hardens and is stiff such as a tamperproof adhesive. Rigid adhesive 202A may be applied on the flaps 102A, 102B in the form of an elongate strip or in the form of intermittent adhesive blocks (as shown) along the length of a connecting interface 102C formed when the flaps 102A, 102B are folded in conjunction, typically at opposite regions and so that the rigid adhesive 202A is sandwiched between the two flaps. A rigid adhesive or rigid tamperproof adhesive may be preferred in this section of container 100 to keep the contents secured as well as a tamper proof means, since the stiff nature of the adhesive when dried will cause an observable disruption such as a tear that may be marked on the material of container 100, specifically along connecting interface 102C of the flaps 102A, 102B.

The container 100 further comprises the auxiliary lid 104 provided on either the operative top end 102-1 or the operative bottom end 102-2 of the container portion 102. The auxiliary lid 104 may be configured to snugly fit on the operative top end 102-1 or the operative bottom end 102-2 of the container portion 102 for providing an improved seal subsequent to the unsealing (and breaking the tamperproof rigid adhesive) of the flaps 102A, 102B, thereby limiting or preventing ingress of air and other foreign matter into the interior space of the container portion 102.

Figure 2A:
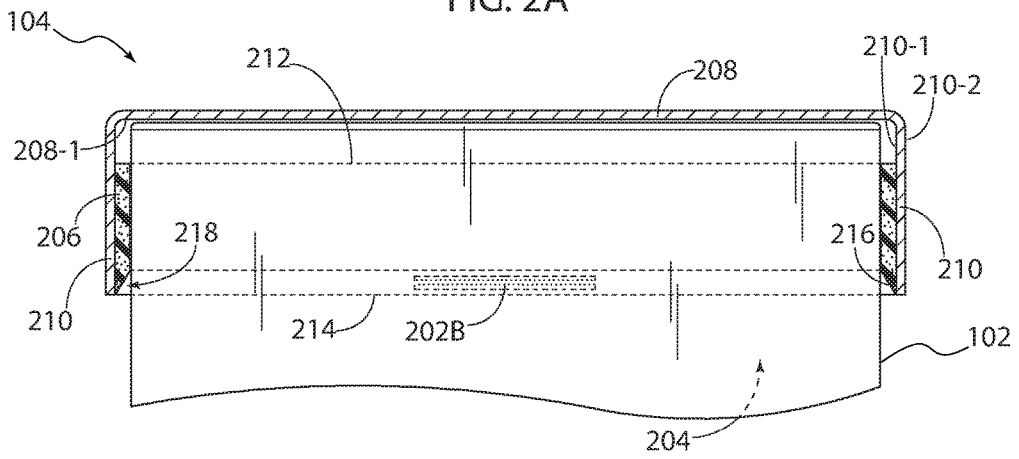
FIG. 2A illustrates a sectional view of an auxiliary lid fitted onto the package container, in accordance with an exemplary embodiment of the present invention.
Figure 2B:
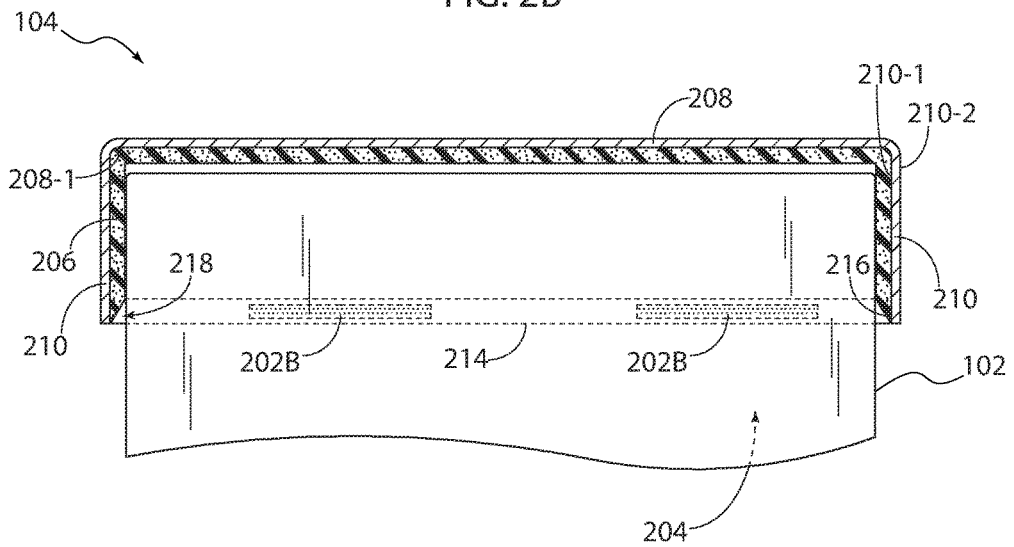
FIG. 2B illustrates a sectional view of an auxiliary lid fitted onto the package container, in accordance with another exemplary embodiment of the present invention.

The next two figures, FIG. 2A and FIG. 2B, depict the sectional views of the auxiliary lid 104 being fitted onto the container portion 102. The container portion 102 is partly depicted in FIG. 2A and FIG. 2B only to illustrate the fitment of the auxiliary lid 104 onto the operative top end 102-1 of the container portion 102. The interior space 204 defined by the at least one sheet has been indicated in FIG. 2A and FIG. 2B as well. As seen in FIG. 2A, the snug and substantially air-tight fitment of the auxiliary lid 104 onto the container portion 102 is facilitated by a foam insert 206.

In exemplary embodiments, the auxiliary lid 104 may be secured to container 100 with a second adhesive, such as a soft adhesive. Contrary to the rigid (typically tamperproof) adhesive 202A that may be used to seal flaps 102A and 102B, such soft adhesive 202B may be removable. In exemplary embodiments, soft adhesive 202B may comprise of a soft pressure-sensitive hot melt adhesive designed to form a temporary bond, and typically can be removed after months or even years without leaving residue on a surface of the container portion 102 or interior of auxiliary lid 104. In the exemplary embodiment shown, an adhesive strip or adhesive blocks 202B are seen in FIG. 2A and FIG. 2B, comprise of a soft pressure-sensitive holt melt adhesive. In exemplary embodiments a single strip or adhesive block 202B may be placed along an internal bottom edge 214 of the auxiliary lid 104. In other exemplary embodiments multiple adhesive blocks situated along the internal bottom edge of the auxiliary lid may be used. In exemplary embodiments, the adhesive block may be more specifically affixed to the auxiliary lid 104 by placement along an angled portion or ridge 216 of the foam insert 206. In such embodiments, the ridge 216 may serve as a surface to place the adhesive block as well as a means to facilitate removal of auxiliary lid 104 from container portion 102 of container 100, since ridge 216 may be angled to provide a space 218 between auxiliary lid 104 and a side wall or surface of container portion 102.

In yet another exemplary embodiment, a foam insert is not included at all, and auxiliary lid 104 may sized slightly larger than a perimeter of the cross-section of container portion 102 of container 100 so that auxiliary lid 104 fits snuggly to cover a portion thereof. In such embodiment, an adhesive strip or adhesive block 202B may be placed directly on inner surface 210-1 of side walls 210, along internal bottom edge 214 of the auxiliary lid 104.

Accordingly, the second adhesive used to secure auxiliary lid 104 to container portion 102 of container 100 is a temporary adhesive useful for providing the package as a unitary piece to a user or consumer. As will be discussed further below with reference to FIG. 4, a consumer may receive or be provided with container 100 (with auxiliary lid 104 removably coupled to container portion 102) and easily remove auxiliary lid 104 from the container portion 102.

After initially opening the container 100, auxiliary lid 104 may be continuously used to seal and unseal the container 100.

As illustrated in FIG. 1A thru FIG. 2B, the auxiliary lid 104 and the container portion 102 have a rectangular cross-section. However, the concept of facilitating a snug and substantially air-tight fitment of the auxiliary lid 104 onto the container portion 102 may be implemented in a packaging container having any cross-sectional profile apart from a rectangular one. Therefore, all such implementations of the packaging container of different shapes utilizing a foam insert to facilitate snug fitment of the auxiliary lid onto the container portion are well within the ambit of the present subject matter.

The auxiliary lid 104, as seen in FIG. 1A thru FIG. 2B has a rectangular cross-section. More specifically, the auxiliary lid 104 comprises a base wall 208 and sidewalls 210 extending from the perimeter of the rectangular base wall 208. Each of the sidewalls 210 has an inner surface 210-1 and an outer surface 210-2. The foam insert 206, as seen in FIG. 2A, may be a strip extending along a periphery defined by the inner surface 210-1 of the sidewalls 210. More specifically, the foam insert 206 may extend along a rectangular periphery defined by all the four sidewalls 210 of the auxiliary lid 104. The foam insert 206 may facilitate the snug and substantially air-tight fitment of the auxiliary lid 104 onto the container portion 102, thereby preventing the air ingress into the interior space 204 and, thus, maintaining the quality of the food item stored therein.

In exemplary embodiments, and without limiting the scope of the present invention, the auxiliary lid 104 illustrated in FIG. 2A may be made of a single sheet of the packaging material by performing folding or bending operations thereon. More specifically, a strip of the foam insert 206 may be attached to the sheet of the packaging material along a rectangular contour 212. The attachment of the foam insert 206 onto the packaging material sheet may be facilitated by a strong permanent adhesive. Subsequent to the attachment of the foam insert 206 onto the packaging material sheet, the same may be folded or bent by the conventional methods to obtain the auxiliary lid 104.

In another embodiment, the auxiliary lid 104 is made of discrete individual panels, wherein the panels are pre-attached with the foam insert 206 and are then adjoined at the edges to form the auxiliary lid 104.

Another embodiment of the auxiliary lid 104 is illustrated in FIG. 2B. As seen in FIG. 2B, the foam insert 206 is provided on a periphery defined inner surfaces 210-1 of the sidewalls 210 as well as on the inner surface 208-1 of the base wall 208.

The auxiliary lid 104 illustrated in FIG. 2B can either be made of a single sheet of the packaging material by performing folding or bending operations thereon. More specifically, the foam insert 206 is stuck whole on the sheet of the packaging material. The attachment of the foam insert onto the packaging material sheet is facilitated by an adhesive. Subsequent to the attachment of the foam insert 206 onto the packaging material sheet, the same may be folded or bent by the conventional methods to obtain the auxiliary lid 104, as seen in FIG. 2B.

In another embodiment, the auxiliary lid 104, as seen in FIG. 2B, is made of discrete individual panels, wherein the panels are pre-attached with the foam insert 206 and are then adjoined at the edges to form the auxiliary lid 104.

Figure 3:
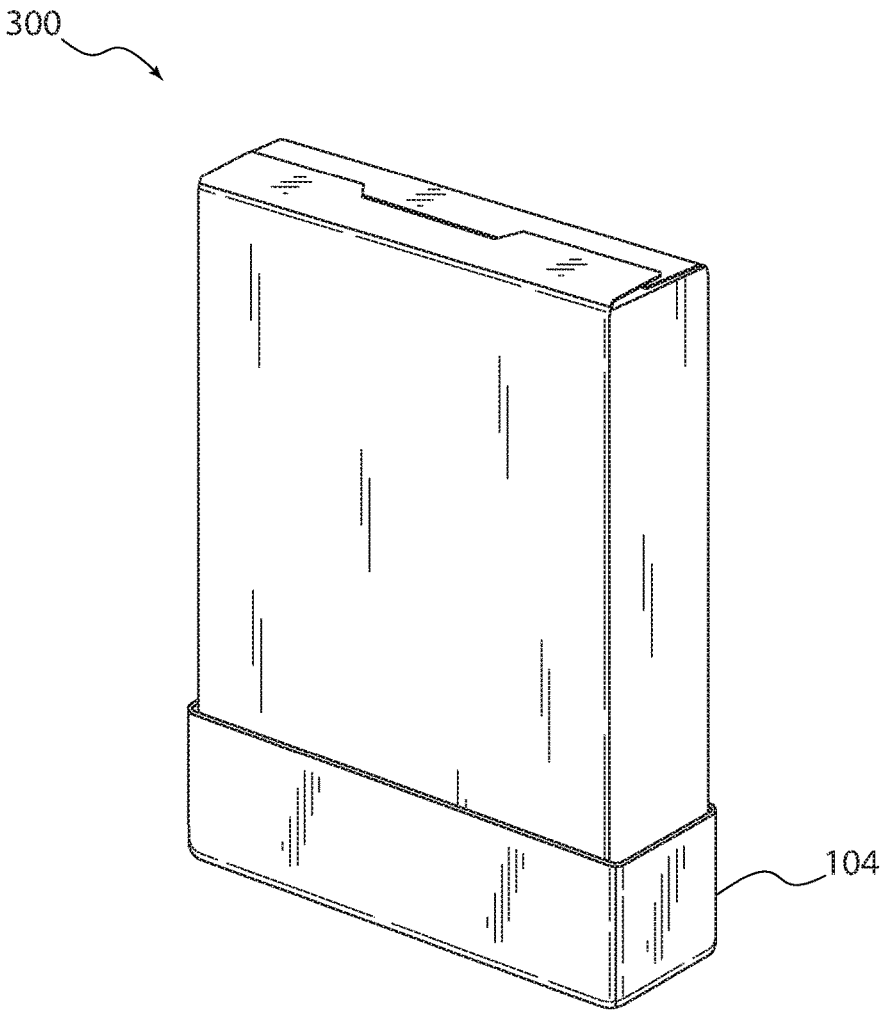
FIG. 3 illustrates an isometric view of a packaging container, in accordance with another exemplary embodiment of the present invention.

Turning to the next figure, FIG. 3 illustrates an isometric view of a packaging container 300, in accordance with another embodiment of the present subject matter. The entire construction and operation of the container 300 are identical to that described above with reference to FIG. 1A thru FIG. 2B. As such, the same is not described again for the sake of brevity of the present document. The only difference is that in the container 300, the auxiliary lid 104 may be provided on the operative bottom end of the container 300. Such a configuration may be provided as a marketing strategy to convey to consumers that the container 300 comes with a complimentary auxiliary lid 104 for keeping the contents of the container 300 crisp and fresh.

The construction and operation of the container 100, 300 is extremely simple, and a user cannot go wrong closing the container portion 102 in the substantially air-tight manner using the auxiliary lid 104. Also, from a manufacturing perspective, the manufacturing of the container 100, 300 is not cost-intensive, since there is no need for any kind of complex sealing mechanisms such as press fit formations or zip-lock formations to be provided anywhere on the container 100. The food items such as cereals and dry fruits may be stored in the container 100 without compromising on the crunchiness and taste thereof. The container 100 can also be used to store food items, in which taste of the food items depends on the aroma of that food item, as the loss of aroma is prevented by virtue of the substantially air-tight fitment of the auxiliary lid 104 onto the container portion 102.

Figure 4:
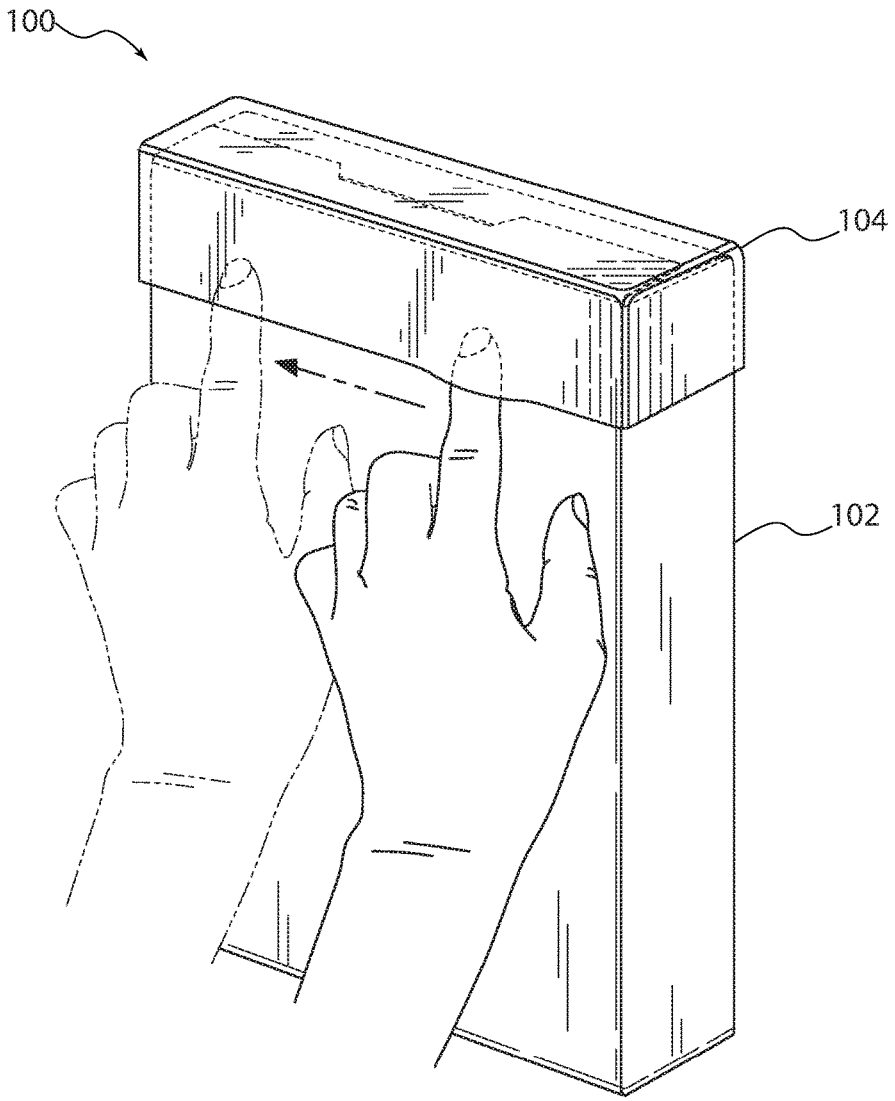
FIG. 4 illustrates a means of unsealing an auxiliary lid from a packaging container in accordance with practice of one embodiment of the present invention.

Turning now to the last figure, FIG. 4 illustrates a means of unsealing auxiliary lid 104 from a packaging container 100 in accordance with practice of one embodiment of the present invention. By way of example, the embodiment shown in FIG. 4 is one in which auxiliary lid 104 has been removably coupled to a top region of container portion 102 via soft pressure-sensitive hot-melt adhesive blocks along a bottom edge. By sliding a finger in-between an inner surface of auxiliary lid 104 and an outer surface of container portion 102 of container 100, an adhesive block 202B may be removed. Because the adhesive of adhesive block 202B is typically soft and removable, no residue will be left on the outer surface of container portion 102. Once the adhesive is removed with the consumer's finger, the auxiliary cap 104 may be slidably decoupled from container portion 102 prior to accessing the food items therein, and slidably coupled to container portion 102 whenever the food items are being stored.

A packaging container with auxiliary lid has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

What is claimed is:

1. A packaging container comprising:

a container portion including:

at least one sheet of a packaging material defining a closed cross-section and open at an operative top end and an operative bottom end thereof; and at least two flaps provided at the operative top end and the operative bottom end of the at least one sheet, the at least two flaps being sealable to each other to define an interior space for containing edible items therein, wherein the at least two flaps are sealed to each other with a rigid adhesive; and an auxiliary lid provided on one of the operative top end or the operative bottom end of the container portion, the auxiliary lid configured to snugly fit on one of the operative top end or the operative bottom end subsequent to an unsealing of the at least two flaps, thereby preventing ingress of air and other foreign matter into the interior space, wherein the auxiliary lid is attached to the container portion with a soft removable adhesive situated along a portion of an internal bottom edge of the auxiliary lid.

2. The packaging container as claimed in claim 1, wherein the rigid adhesive is a tamperproof adhesive.

3. The packaging container as claimed in claim 1, wherein the soft removable adhesive is a pressure-sensitive hot melt adhesive.

4. The packaging container as claimed in claim 1, wherein the soft removable adhesive comprises multiple adhesive blocks situated along the internal bottom edge of the auxiliary lid.

5. The packaging container as claimed in claim 1, wherein the soft removable adhesive comprises a single adhesive block situated along the internal bottom edge of the auxiliary lid.

6. The packaging container as claimed in claim 1, wherein the auxiliary lid comprises a foam insert affixed to an inner periphery of the auxiliary lid for facilitating snug fitment of the auxiliary lid on the operative top end or the operative bottom end of the container portion.

7. The packaging container as claimed in claim 6, wherein the foam insert includes a ridge along the internal bottom edge of the auxiliary lid.

8. The packaging container as claimed in claim 6, wherein the soft removable adhesive is applied along the ridge.

9. The packaging container as claimed in claim 6, wherein the auxiliary lid comprises a base wall and sidewalls extending from the base wall.

10. The packaging container as claimed in claim 9, wherein the foam insert is a strip extending along a periphery defined by inner surfaces of the sidewalls.

11. The packaging container as claimed in claim 9, wherein the foam insert is a sheet affixed to a periphery defined by inner surfaces of the base wall and the sidewalls.

12. An auxiliary lid for covering a packaging box subsequent to the opening of the packaging box, the auxiliary lid comprising:

a base wall; and at least one sidewall extending from the base wall and defining a profile complementary to that of the packaging box for fitting on an operative top end or an operative bottom end of the packaging box, wherein:

the auxiliary lid is attached to a container portion of the packaging box with a soft removable adhesive situated along a portion of an internal bottom edge of the auxiliary lid; and the package box comprises of a container portion including at least one sheet of a packaging material defining a closed cross-section and open at the operative top end and the operative bottom end of the packaging box, and at least two flaps provided at the operative top end and the operative bottom end of the at least one sheet, the at least two flaps being sealable to each other to define an interior space for containing edible items therein, the at least two flaps sealed to each other with a rigid adhesive.

13. The packaging container as claimed in claim 12, wherein the soft removable adhesive is a pressure-sensitive hot melt adhesive.

14. The auxiliary lid as claimed in claim 12, further comprising:

a foam insert affixed to an inner periphery of the auxiliary lid for facilitating a snug fitment of the auxiliary lid on the packaging box, thereby preventing ingress of air and other foreign matter in the packaging box.

15. The auxiliary lid as claimed in claim 14, wherein the base wall has a rectangular profile.

16. The auxiliary lid as claimed in claim 15, wherein the auxiliary lid comprises four sidewalls extending from each edge of the base wall.

17. The auxiliary lid as claimed in claim 16, wherein the base wall and the four sidewalls are formed by performing folding or bending operation on a single sheet of a packaging material.

18. The auxiliary lid as claimed in claim 16, wherein the base wall and the four sidewalls are discrete individual elements that are adjoined together to form the auxiliary lid.

19. The auxiliary lid as claimed in claim 16, wherein the foam insert is a strip extending along an inner periphery defined by inner surfaces of the four sidewalls.

20. The auxiliary lid as claimed in claim 16, wherein the foam insert is a sheet affixed to an inner periphery defined by inner surfaces of the four sidewalls and an inner surface of the base wall.

* * * * *